US006814106B1

(12) United States Patent
Iizuka

(10) Patent No.: US 6,814,106 B1
(45) Date of Patent: Nov. 9, 2004

(54) DUCT JOINT STRUCTURE

(75) Inventor: Shozo Iizuka, Himeji (JP)

(73) Assignee: Sir System Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/258,707

(22) PCT Filed: Apr. 27, 2000

(86) PCT No.: PCT/JP00/02746

§ 371 (c)(1),
(2), (4) Date: Oct. 25, 2002

(87) PCT Pub. No.: WO01/84058

PCT Pub. Date: Nov. 8, 2001

(51) Int. Cl.[7] ..... F16L 9/00

(52) U.S. Cl. ..... 138/163; 138/157; 138/162; 138/177; 138/DIG. 4

(58) Field of Search ..... 138/163, 157, 138/162, 177, 155, DIG. 4

(56) References Cited

U.S. PATENT DOCUMENTS

| | | | | | |
|---|---|---|---|---|---|
| 2,286,118 | A | * | 6/1942 | Sleeth | 248/58 |
| 2,847,034 | A | * | 8/1958 | Swett | 285/399 |
| 3,089,521 | A | * | 5/1963 | Paiement | 138/158 |
| 3,701,194 | A | * | 10/1972 | Widman | 29/278 |
| 3,858,540 | A | * | 1/1975 | Berg | 138/163 |
| 4,423,284 | A | * | 12/1983 | Kaplan | 174/101 |
| 4,681,155 | A | * | 7/1987 | Kredo | 165/76 |
| 5,125,199 | A | * | 6/1992 | Whitney et al. | 52/220.3 |
| 5,353,616 | A | * | 10/1994 | Fischer et al. | 72/51 |
| 5,996,644 | A | * | 12/1999 | Iizuka | 138/163 |
| 6,056,021 | A | * | 5/2000 | Iizuka | 138/163 |

FOREIGN PATENT DOCUMENTS

| | | |
|---|---|---|
| JP | 58-127279 | 8/1983 |
| JP | 07-234005 | 9/1995 |
| JP | 10-047741 | 2/1998 |

OTHER PUBLICATIONS

Japanese Patent Office; International Search Report for PCT/JP00/02746; Jul. 25, 2000 (1 page).
English Translation of the International Preliminary Examination Report dated Nov. 27, 2001 from WIPO for International Patent Application PCT/JP00/02746.

* cited by examiner

*Primary Examiner*—Patrick Brinson
(74) *Attorney, Agent, or Firm*—Marshall, Gerstein & Horun LLP

(57) ABSTRACT

An objective of the present invention is to provide a joint structure of a duct that can be formed easily and comprising features of the joint structure of a novel duct previously filed by the present applicant. A tip end portion of one of two plate members is bent to form an angle of 90 degrees or more, a U-shaped groove is formed at an tip end portion of the other plate member such that at least an opening portion of the groove is adapted to a bending angle of the one plate member so as to accommodate the bent tip end portion of the one plate member in an end portion of the other plate member, and the guide rail is formed by protruding at least a portion on a bottom side of the U-shaped groove of the other plate member obliquely from an outer face located on a base end side of a portion where the U-shaped groove is formed and constituting one of the wall faces of the duct.

3 Claims, 22 Drawing Sheets

(a)

(b)

(a)

(b)

(a)

(b)

(a)

(b)

(a)

(b)

(a)

(b)

DUCT JOINT STRUCTURE

TECHNICAL FIELD

The present invention relates to a joint structure of a jointing portion between plate members constituting a duct used for air-conditioning or ventilating equipment as one of building equipment.

BACKGROUND ART

Traditional mode of ducts (see FIG. 19) have been conventionally used for air-conditioning or ventilating equipment for last 100 years or more. The present inventor provided a novel mode of duct as shown in FIGS. 17, 18, which can be assembled with a minimum of noise, delivered and stored with high efficiency, and hung through a simple operation and with high degree of freedom in terms of the position at which the duct is hung (Japanese Laid-Open Patent Publication No. Hei 10-47741).

Because of the features described above, the novel mode of duct shown in FIGS. 17, 18 has attracted the attention from the duct industries in the United States, European countries, and other countries, not to mention Japan.

However, the novel mode of duct can not be easily manufactured by a conventional duct forming machine or even by an improved version of the conventional duct forming machine because the structure of a joint portion of the novel mode of duct is more complicated than that of the conventional duct and new. That is, as shown in FIGS. 17, 18, a thin plate member is bent twice, and a portion of the bent plate member is required to be further bent. Thus, the influence of the distortion, etc. is complicated and large, making the sheet metal working more difficult as compared to the joint structure of the conventional duct. Consequently, the novel mode of duct is not something that anybody can fabricate easily even with a new forming machine incorporating the conventional sheet metal working technologies. That is, a desired shape may be obtained if a number of required conditions are all satisfied, however, the desired shape can be no longer formed if one of the required conditions changes because of, for example, a change in surface roughness of a forming roller with use.

The present invention has been developed under these circumstances, and an object thereof is to provide a joint structure of a duct formed easily and having the features of the novel duct described above.

DISCLOSURE OF THE INVENTION

To solve the above-described technical problem, according to the first invention, there is provided a joint structure of a duct in which a guide rail extends along a jointing line at which two plate members are substantially orthogonal to each other in cross section in the vicinity of the jointing line, the joint structure of the duct characterized in that:

an end portion of the one of the two plate members is bent to form an angle of 90 degrees or more;

a U-shaped groove (not only an exactly U-shaped groove but also a groove opened in one direction, such as an reversed-Ωor inverted-V shaped groove) is formed at an end portion of the other plate member such that at least a portion in the vicinity of an opening portion of the groove is adapted to the bending angle of the bent end portion of the one plate member so as to accommodate a tip end portion of the bent portion of the one plate member;

the guide rail is formed by protruding at least a bottom portion of the U-shaped groove of the other plate member from an outer face located on a base end side of a portion where the U-shaped groove is formed and constituting one of walls of the duct.

Therefore, according to the joint structure so constituted, the number of portions to be bent during forming can be reduced to its half as compared to the conventional new joint structure of the duct, and a forming step in which a portion of a bent plate member is further bent can be eliminated, thereby enabling simple and stable fabrication.

Furthermore, the joint structure so constituted can have the feature of the joint structure of the conventional new duct that it can be assembled with a minimum of noise, delivered and stored with high efficiency, and hung through a simple operation and with high degree of freedom in terms of the position at which the duct is hung.

Furthermore, in the joint structure of the duct, the extension of a U-shaped groove obliquely and linearly with respect to an outer face located on a base end side thereof and constituting one of the wall faces of the duct can offer a very simple and preferred embodiment.

Even furthermore, in the joint structure of the duct, a U-shaped groove can be constituted such that a tip end portion of the bent portion of the one plate member is accommodated in a portion in the vicinity of an opening portion thereof, and a bottom portion of the U-shaped groove protrudes with respect to an outer face located on the base end side and constituting one of the wall faces of the duct.

BRIEF DESCRIPTION OF THE DRAWINGS

FIG. 22 is a view showing a hanger for hanging a duct assembled with a joint structure according to the present invention from a ceiling or the like.

BEST MODE FOR CARRYING OUT THE INVENTION

Hereinafter, a joint structure of a duct according to embodiments of the present invention will be described in detail with reference to accompanying drawings.

First Embodiment

A first embodiment in which a joint structure of a duct according to the present invention is applied to a so-called "Pittsburgh Seam" will be described.

Figure 1:
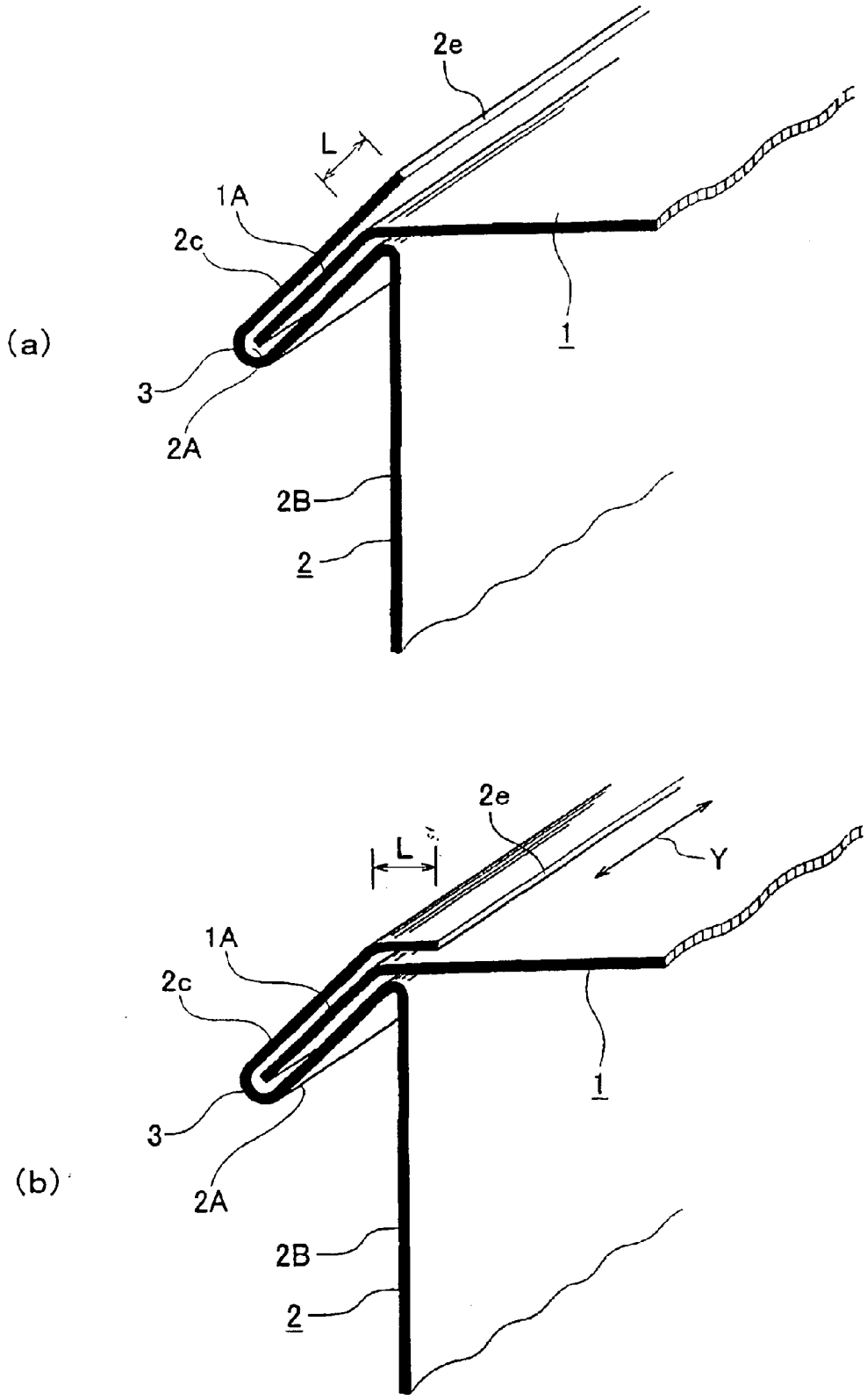
FIG. 1 is a partially enlarged view showing a constitution of a joint structure of a duct according to the first embodiment of the present invention, wherein FIG. 1(*a*) is a view showing a state before the assembly is completed, and FIG. 1(*b*) is a view showing a state after the assembly is completed.
Figure 2:
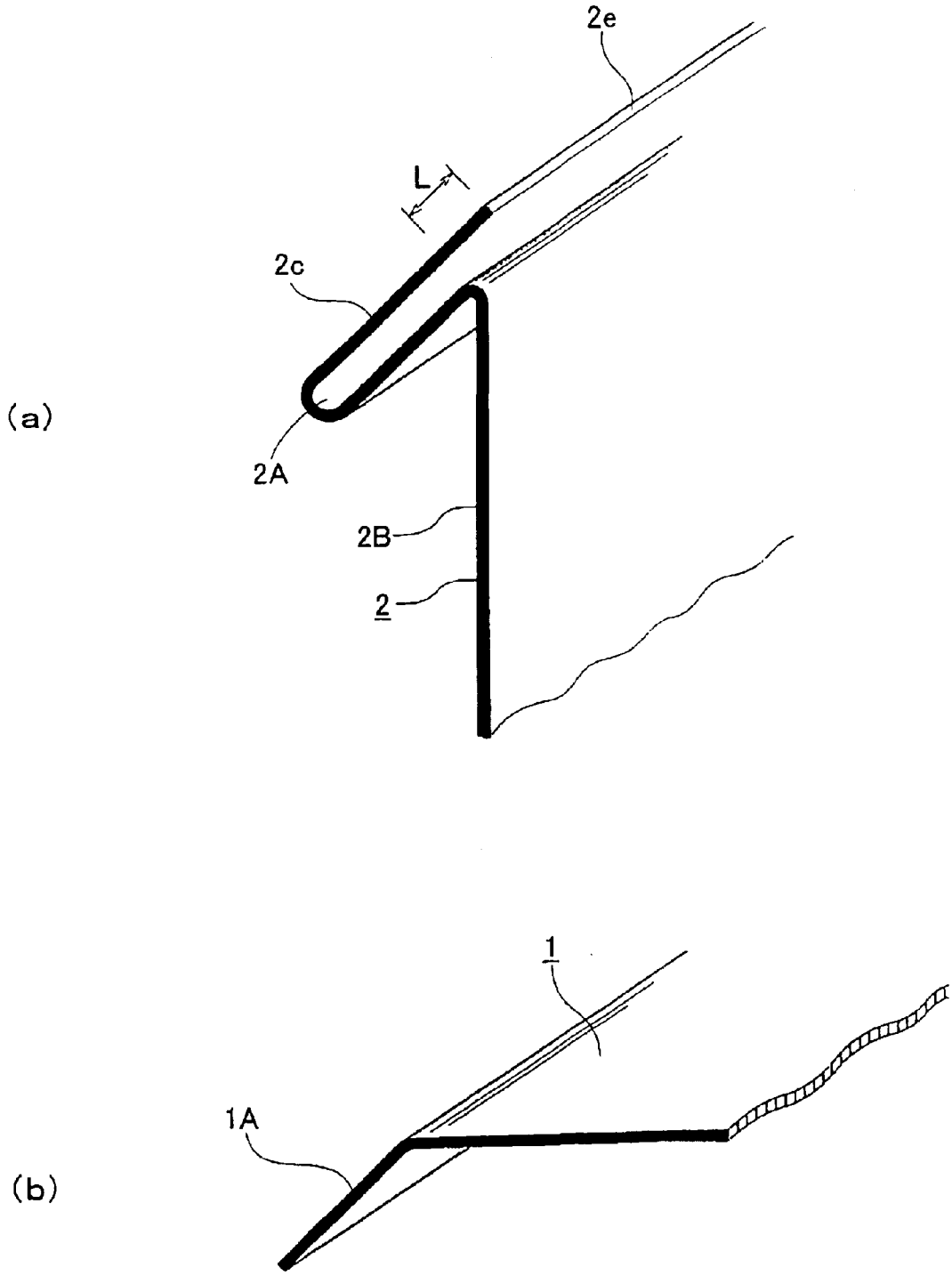
FIG. 2 is a view showing one plate member and the other plate member constituting the joint structure shown in of FIG. 1, wherein FIG. 2(*a*) is a perspective view showing the other member (plate member) of the joint structure shown in FIG. 1, and FIG. 2(*b*) is a perspective view showing the one member (plate member) of the joint structure shown in FIG. 1.

FIG. 1 is partially enlarged views showing a structure of a joint portion of a duct, wherein FIG. 1(*a*) is a view showing a state before the assembly is completed, and FIG. 1(*b*) is a view showing a state after the assembly is completed. FIG. 2(*a*) and FIG. 2(*b*) are views showing one member (plate member) and the other member (plate member) constituting the joint structure shown in FIG. 1.

In these figures, reference numeral 1 denotes the one plate member (e.g. a thin plate member made of metal), and reference numeral 2 denotes the other plate member (e.g. a thin plate member made of metal). A tip end portion 1A of the one plate member 1, that is, a left end portion in FIG. 2(*b*) is bent to form an angle of substantially 90 degrees or more, for example approximately 135 degrees in this embodiment.

Furthermore, a U-shaped groove 2A is formed at a tip end portion 2*c* of the other plate member 2 to be adapted to a bending angle of the one plate member 1, that is, by being bent by approximately 45 degrees with respect to an outer face 2B located on a base end side of the U-shaped groove 2A in this embodiment. Furthermore, the U-shaped groove 2A protrudes obliquely and linearly (in the leftward and downward direction in FIG. 1) from the outer face 2B located on the base end side of the other member 2 and constituting one of the wall faces of the duct.

Thus, a guide rail 3 is formed by the U-shaped groove 2A along the longitudinal direction of the duct (a jointing line where the two plate members are in contact with each other; see the direction of the arrow Y in FIG. 1(*b*)).

A free end 2*e* located farther toward a tip end side of the U-shaped groove 2A extends so as to protrude from an imaginary line extended from the outer face 2B on the base end side toward-an opposite side of the U-shaped groove (toward the right side in FIG. 1(*a*)). A dimension of the extension L may be suitably determined, however, the dimension may be at least long enough to prevent the one member 1 from coming off the U-shaped groove 2A after the assembly is completed as described below.

Figure 17:
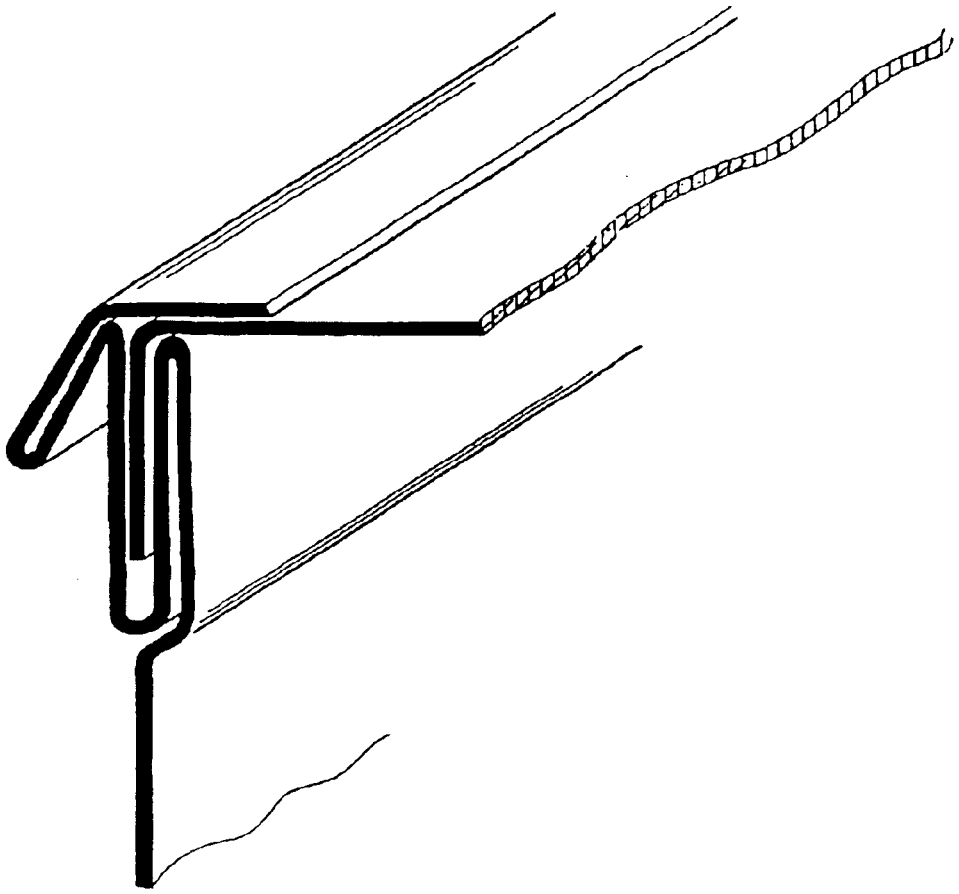
FIG. 17 is a partially enlarged perspective view showing a joint structure of a duct according to a prior invention of the present inventor.

Therefore, the joint structure of the duct thus constituted can be formed easily and stably since the number of bent portions is smaller than that of the joint structure of the duct shown in FIG. 17, and there is no such a bent portion that a bent portion is further bent. Thus, designing and constructing a forming machine specifically for the joint structure described will enable the joint structure to be formed automatically. Furthermore, since the number of bent portions is smaller, and there is no such a bent portion that a bent portion is further bent, the number of forming rollers (in other words, the number of forming steps) can be reduced, and a forming machine with simple structure can be used for the forming.

Furthermore, in view of strength, the rigidity of the joint structure is reduced since the number of bent portions is smaller as compared to the joint structure of the duct shown in FIG. 17, and thus the geometric moment of inertia will be reduced. However, this problem can be easily avoided by increasing tile thickness of the plate members.

In assembling the joint having the one member 1 and the other member 2, as illustrated in FIG. 1(*a*), the bent tip end portion (the left end portion) 1A of the one member 1 is inserted into the inside through the opening of the U-shaped groove 2A of the other member 2, and thereafter, an extended portion on the free end 2*e* side of the other member 2 is bent so as to conform to an upper face of the one member 1 as shown in 1(*b*), thereby jointing the jointing portions of the two members constituting the duct. It should be noted that such a jointing portion is to be formed at four corners, that is, four positions of the duct.

Second Embodiment

Another embodiment (a second embodiment) in which a joint structure of a duct according to the present invention is applied to a so-called "Pittsburgh Seam" will be described.

Figure 3:
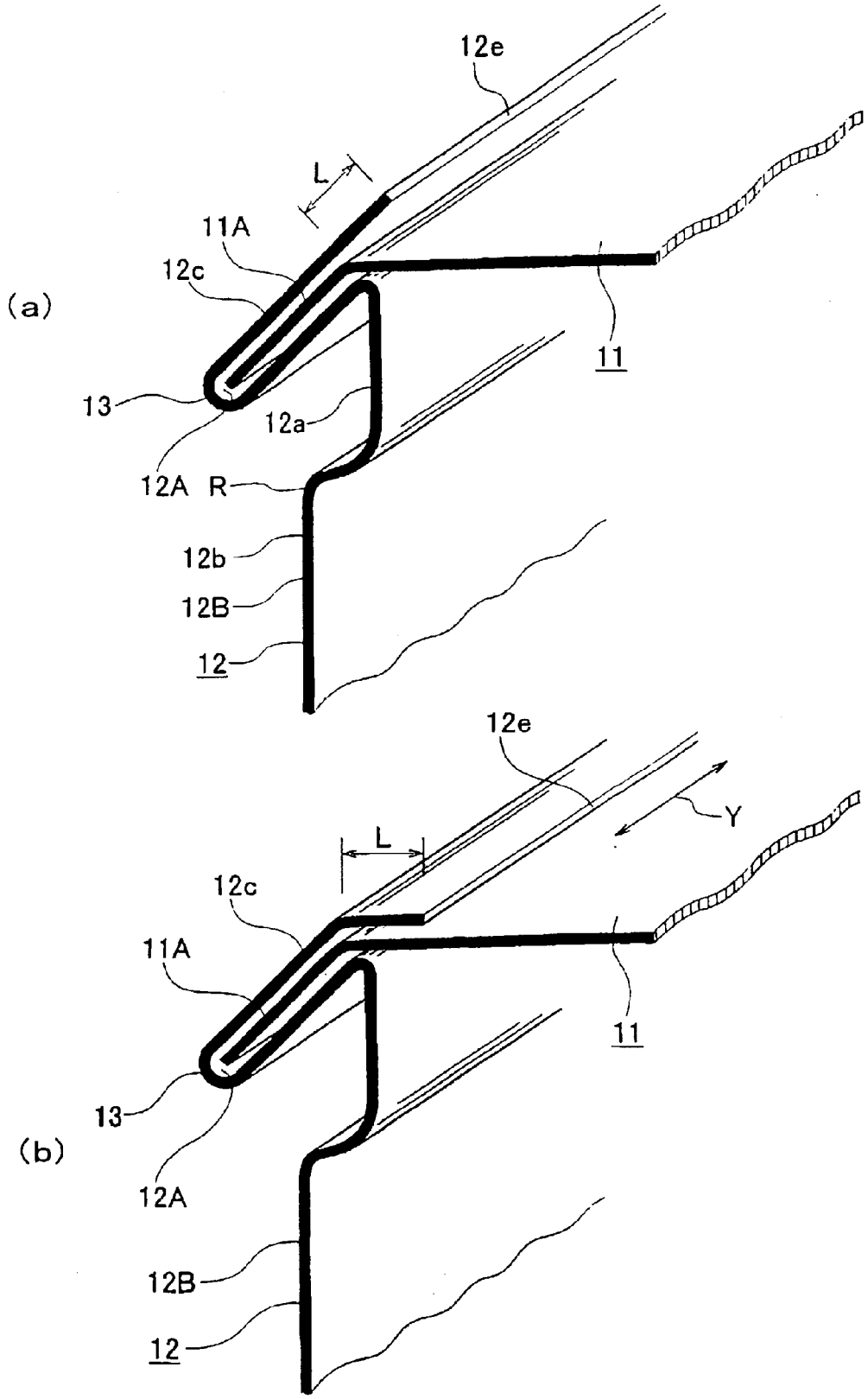
FIG. 3 is a partially enlarged view showing a constitution of a joint structure of a duct according to the second embodiment of the present invention, wherein FIG. 3(*a*) is a partially enlarged view showing a state before the assembly is completed, and FIG. 3(*b*) is a partially enlarged view showing a state after the assembly is completed.
Figure 4:
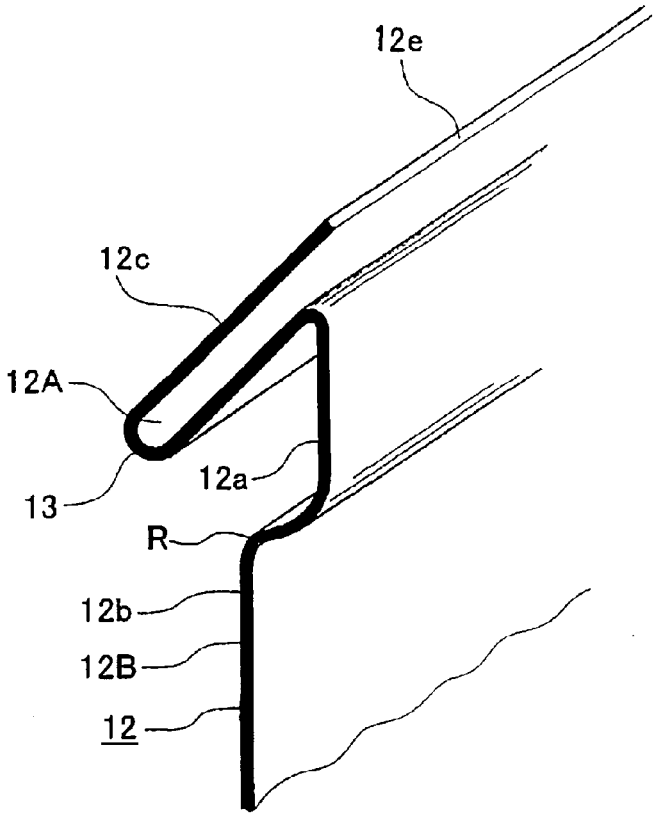
FIG. 4 is a view showing one plate member and the other plate member constituting the joint structure shown in of FIG. 3, wherein FIG. 4(*a*) is a perspective view showing the other member (plate member) of the joint structure shown in FIG. 1, and FIG. 4(*b*) is a perspective view showing the one plate member of the joint structure shown in FIG. 1.
Figure 4:
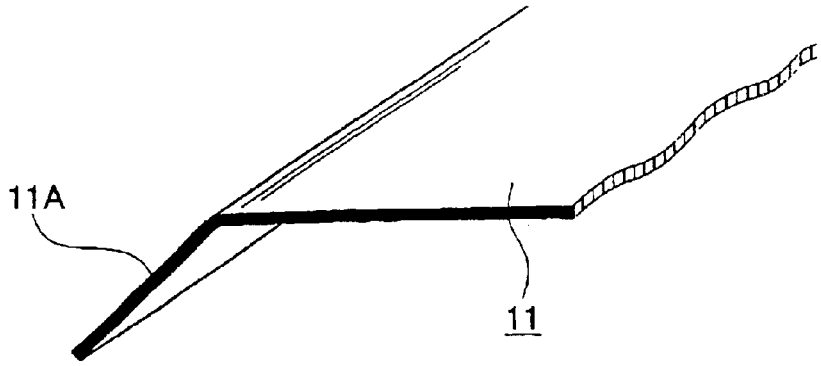

FIG. 3 is partially enlarged views showing a constitution of a joint portion of a duct, wherein FIG. 3(*a*) is a view showing a state before the assembly is completed, and FIG. 3(*b*) is a view showing a state after the assembly is completed. FIG. 4(*a*) and FIG. 4(*b*) are views showing one member and the other member constituting the joint structure shown in FIG. 3.

In these figures, reference numeral 11 denotes the one plate member, and reference numeral 12 denotes the other plate member. A tip portion 11A of the one plate member 11, that is, a left end portion in FIG. 4(*b*) is bent to form an angle of approximately 90 degrees or more, for example, an angle of approximately 135 degrees in this embodiment. In this respect, the second embodiment is identical to the first embodiment.

Furthermore, a U-shaped groove 12A is formed by bending a tip portion 12*c* of the other plate member 12 to be adapted to a bending angle of the one plate member 11, that is, approximately 45 degrees with respect to an outer face 12B located on a base end side of the U-shaped groove 12A in this embodiment. The U-shaped groove 12A protrudes linearly and obliquely (in the leftward and downward direction in FIG. 3) from the outer face 12B located on the base end side of the other member 12 and constituting one of the wall faces of the duct.

Thus, a guide rail 13 extends along the longitudinal direction (a jointing line where the two plate members are in contact with each other; see the direction of the arrow Y in FIG. 3(*b*)) of the duct.

A free end 12*e* located farther toward a tip end side of the U-shaped groove 2A extends so as to protrude from an imaginary line extended from the outer face 12B on the base end side toward an opposite side of the U-shaped groove 12A (toward the right side in FIG. 3(*a*)). The second embodiment is identical to the first embodiment in terms of a dimension of the extension L.

By the way, according to the second embodiment, a step-shaped bent portion R is formed between an upper end portion 12*a* and a lower end portion 12*b* of the outer face 12B positioned on the base end side of the other member 12 such that the lower end portion 12*b* protrudes more greatly than the upper end portion 12*a* toward the U-shaped groove 12A.

Therefore, according to the joint structure of the duct thus constituted, the same function and effects as the first embodiment can be achieved, and the geometric moment of inertia of the other member and hence the joint structure portion of the duct increases because the step-shaped bent portion R is formed between the upper end portion 12*a* and the lower end portion 12*b*, thereby increasing the rigidity of the joint structure portion of the duct. Furthermore, the degree by which the U-shaped groove protrudes from the lower end portion 12*b* of the outer face 12B positioned on the base end side thereof can be reduced, thereby achieving the duct having the guide rail protruding less from the outer face 12B. In other words, if the outer dimension of a duct is constant, then, a duct with a large effective ventilating cross-sectional area can be achieved.

Third Embodiment

Another embodiment (a third embodiment) in which a joint structure of a duct according to the present invention is applied to a so-called "Pittsburgh Seam" will be described.

Figure 5:
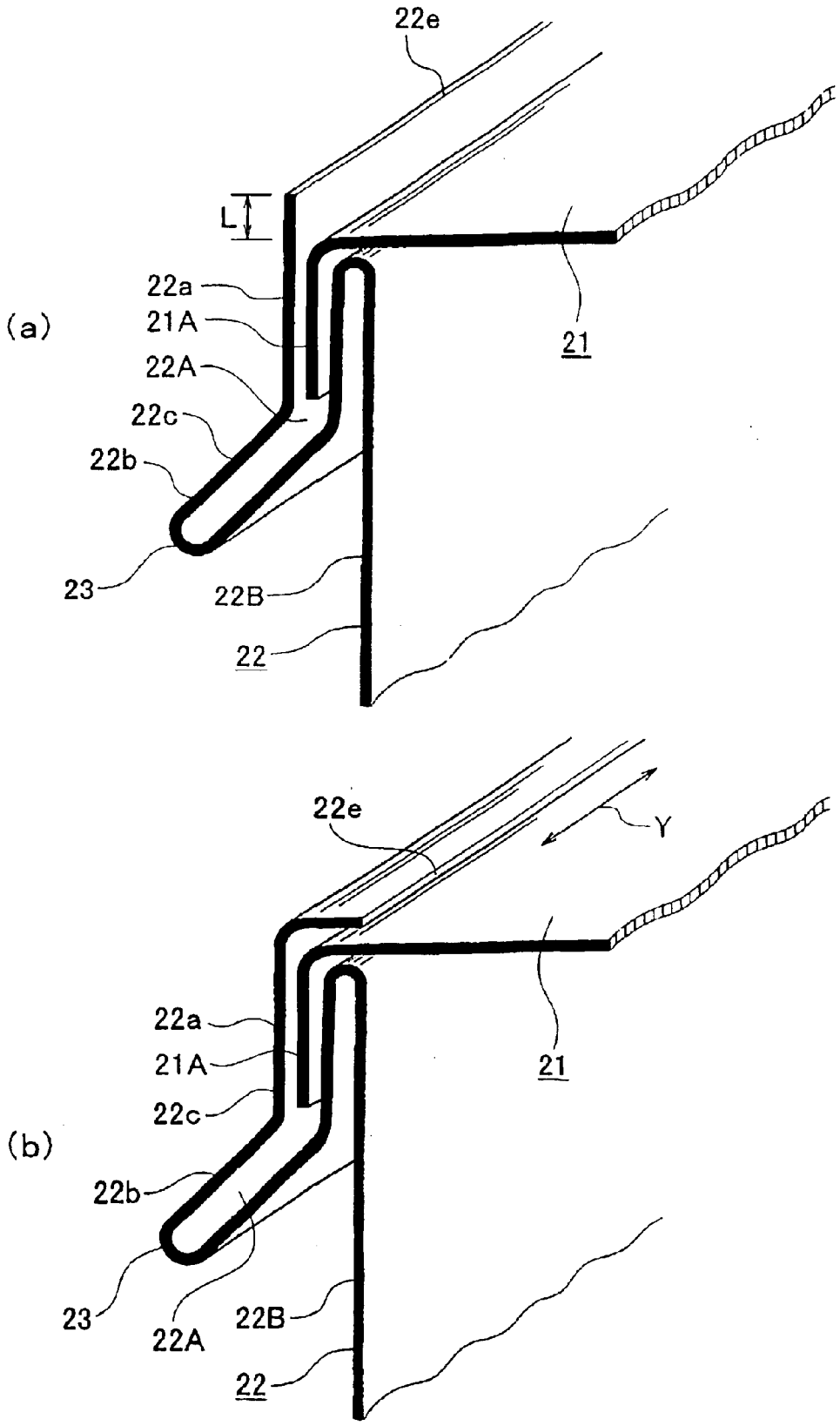
FIG. 5 is a partially enlarged view showing a constitution of a joint structure of a duct according to the third embodiment of the present invention, wherein FIG. 5(*a*) is a view showing a state before the assembly is completed, and FIG. 5(*b*) is a view showing a state after the assembly is completed.
Figure 6:
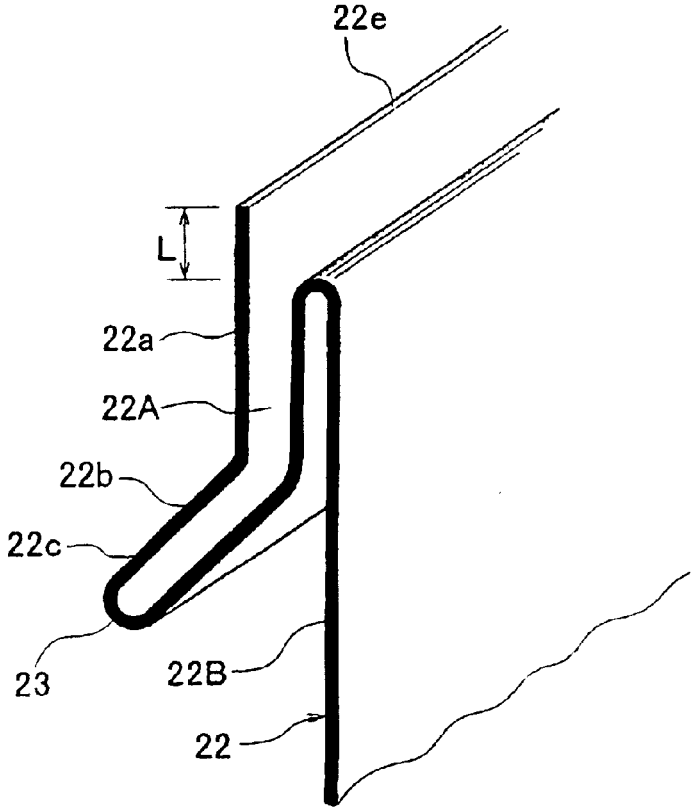
FIG. 6 is a view showing one plate member and the other plate member constituting the joint structure shown in of FIG. 5, wherein FIG. 6(*a*) is a perspective view showing the other member (plate member) of the joint structure shown in FIG. 1, and FIG. 6(*b*) is a perspective view showing the one member (plate member) of the joint structure shown in FIG. 1.
Figure 6:
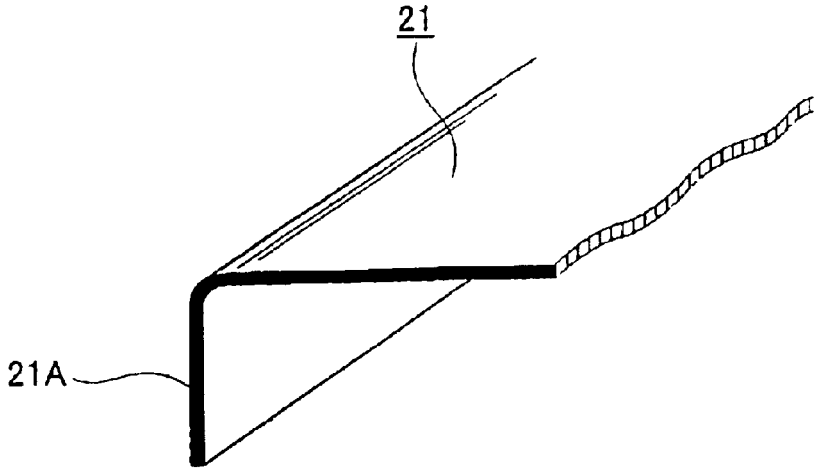

FIG. 5 is partially enlarged views showing a structure of a joint portion of a duct, wherein FIG. 5(*a*) is a view showing a state before the assembly is completed, and FIG. 5(*b*) is a view showing a state after the assembly is completed. FIG. 6(*a*) and FIG. 6(*b*) are views showing one member and the other member constituting the joint structure shown in FIG. 5.

In these figures, reference numeral 21 denotes the one plate member, and reference numeral 22 denotes the other plate member. A tip end portion 21A of the one plate member 21, that is, a left end portion in FIG. 6(*b*) is bent to form an angle of approximately 90 degrees or more, for example, an angle of approximately 90 degrees in this embodiment.

Furthermore, a U-shaped groove 22A is formed at a tip end portion 22*c* of the other plate member 22. In the third embodiment, an upper end portion (a portion in the vicinity of an opening) 22*a* of the U-shaped groove 22A is bent to be adapted to a bending angle of the one plate member 21, that is, approximately 90 degrees in this embodiment, and a lower end portion (a portion on the bottom side) 22*b* is bent by an angle of approximately 45 degrees with respect to the outer face 22B located on a base end side of the U-shaped groove and constituting one of the wall faces of the duct. That is, in the third embodiment, the U-shaped groove 22A is bent obliquely and outwardly (laterally; in the leftward and downward direction in FIG. 6(*a*)) at an arbitrary position such that a bottom side of the U-shaped groove protrudes from the outer face 22B.

A guide rail 23 is formed by a portion on the bottom side of the U-shaped groove 22A along the longitudinal direction (a jointing line where the two plate members are in contact with each other; see the direction of the arrow Y in FIG. 5(*b*)) of the duct.

A free end 22*e* located on a tip end side of the U-shaped groove 12A extends so as to protrude upwardly from an upper end of the outer face 22B on the base end side. The third embodiment is identical to the first embodiment and the second embodiment in terms of a dimension of the extension L.

Therefore, the joint structure of the duct thus constituted provides the same function and effects as the first and second embodiments, and the geometric moment of inertia of the other member 22 and hence the joint structure portion of the duct increases because the U-shaped groove 22A is bent at an arbitrary position, thereby increasing the rigidity of the joint structure portion.

Fourth Embodiment

Another embodiment (a fourth embodiment) in which a joint structure of a duct according to the present invention is applied to a so-called "Pittsburgh Seam" will be described.

Figure 7:
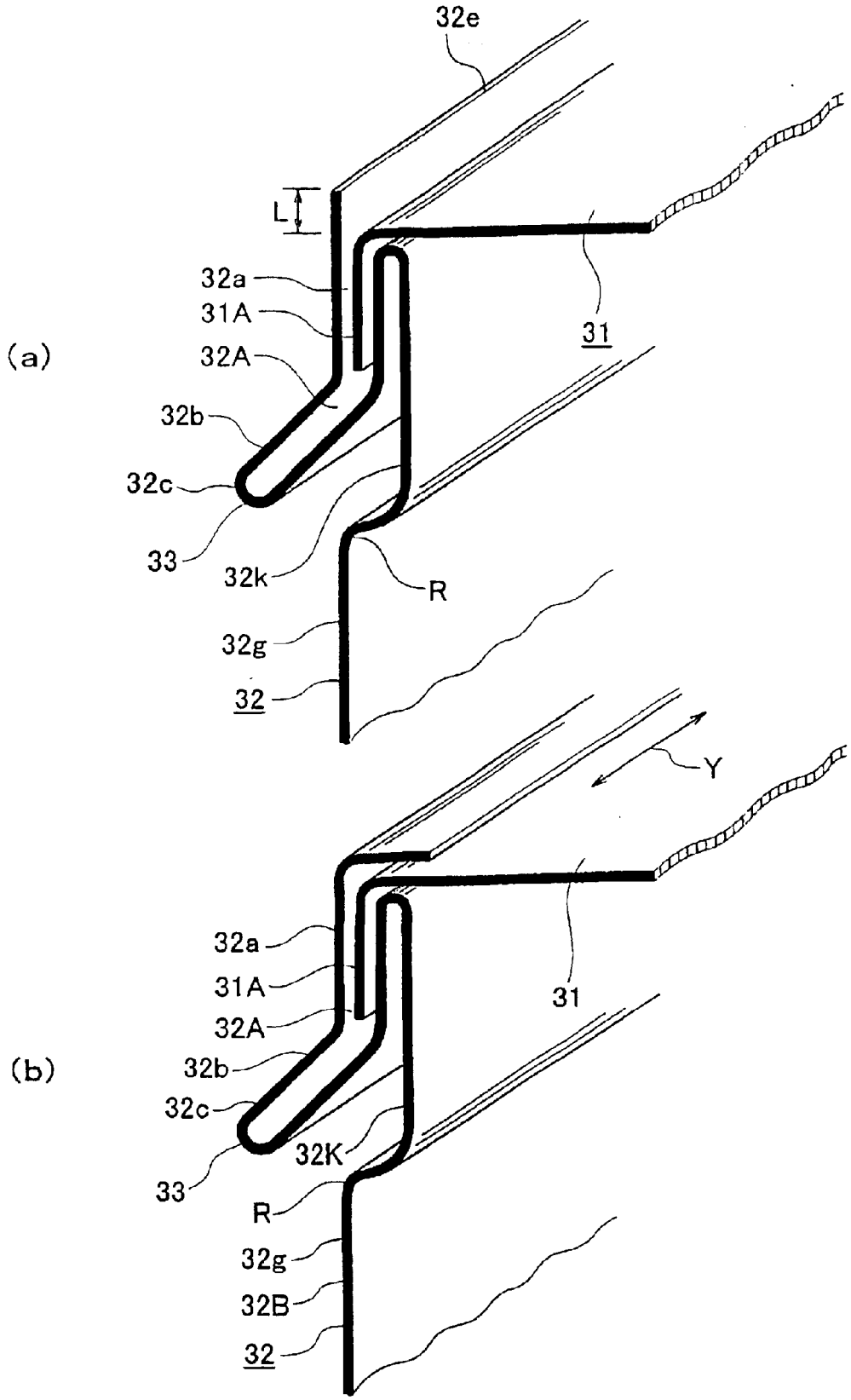
FIG. 7 is a partially enlarged view showing a constitution of a joint structure of a duct according to the fourth embodiment of the present invention, wherein FIG. 7(*a*) is a view showing a state before the assembly is completed, and FIG. 7(*b*) is a view showing a state after the assembly is completed.
Figure 8:
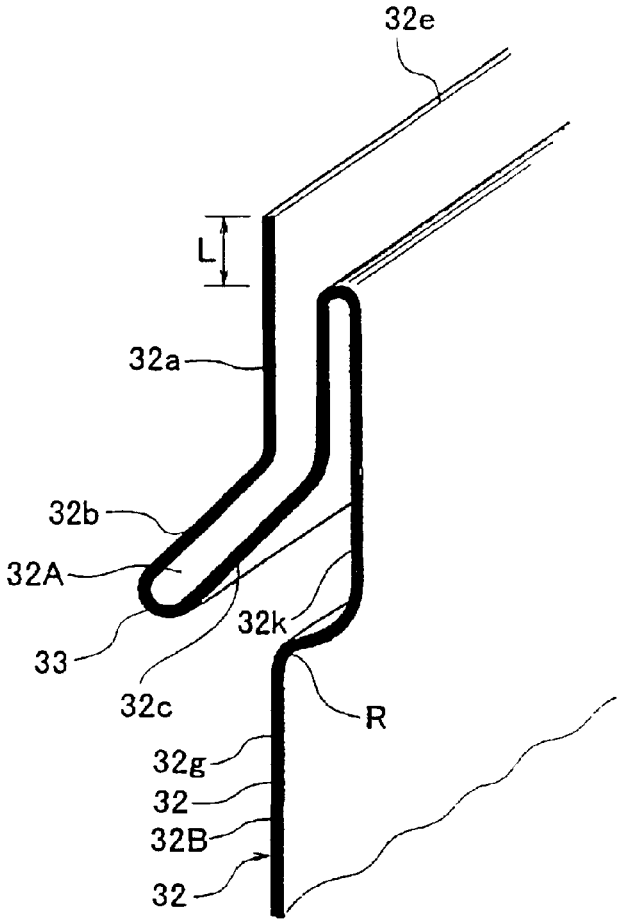
FIG. 8 is a view showing one plate member and the other plate member constituting the joint structure shown in of FIG. 7, wherein FIG. 8(*a*) is a perspective view showing the other member (plate member) of the joint structure shown in FIG. 1, and FIG. 8(*b*) is a perspective view showing the one member (plate member) of the joint structure shown in FIG. 1.
Figure 8:
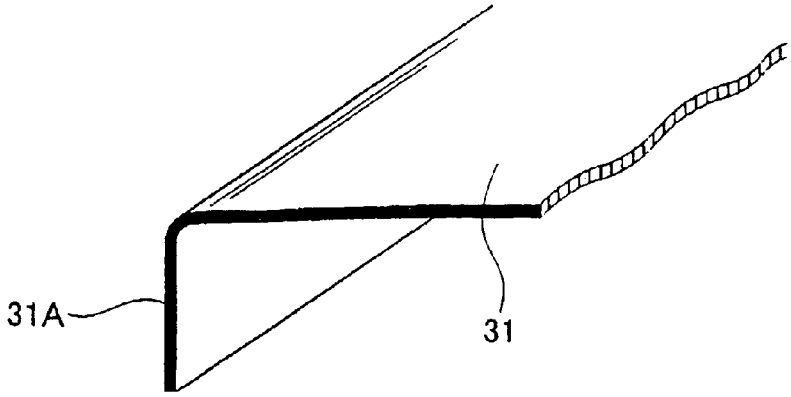

FIG. 7 is partially enlarged views showing a structure of a joint portion of a duct, wherein FIG. 7(*a*) is a view showing a state before the assembly is completed, and FIG. 7(*b*) is a view showing a state after the assembly is completed. FIG. 8(*a*) and FIG. 8(*b*) are views showing one member and the other member constituting the joint structure shown in FIG. 7.

In these figures, reference numeral 31 denotes the one plate member, and reference numeral 32 denotes the other plate member. A tip end portion 31A of the one plate member 31, that is, a left end portion in FIG. 6(*b*) is bent to form an angle of approximately 90 degrees or more, for example, an angle of approximately 90 degrees in this embodiment.

Furthermore, a U-shaped groove 32A is formed at a tip end portion 32*c* of the other plate member 32. In the fourth embodiment, an upper end portion (a portion in the vicinity of an opening) 32*a* of the U-shaped groove 32A is bent to be adapted to a bending angle of the one plate member 21, that is, approximately 90 degrees in this embodiment, and a lower end portion (a portion on the bottom side) 32*b* is bent by an angle of approximately 45 degrees with respect to the outer face 32B located on a base end of the U-shaped groove 32A and constituting one of the wall faces of the duct. That is, in the fourth embodiment, the U-shaped groove 32A is bent obliquely and outwardly (laterally; in the leftward and downward direction in FIGS. 7(*a*), 8(*a*)) at an arbitrary position such that a bottom side of the U-shaped groove protrudes from the outer face 32B.

Thus, a guide rail 33 is formed by a portion on the bottom side of the U-shaped groove 32A along the longitudinal direction (a jointing line where the two plate members are in contact with each other; see the direction of the arrow Y in FIG. 7(*b*)) of the duct.

Furthermore, in the fourth embodiment, similarly to the second embodiment, a step-shaped bent portion R is also formed between an upper end portion 32*k* and a lower end portion 32*g* of the outer face 32B located on a base end side of the other member 32 such that the lower end portion 32*g* protrudes more greatly than the upper end portion 32*k* toward the U-shaped groove 32A.

A free end 32*e* located on a tip end portion of the U-shaped groove 12A extends so as to protrude upwardly from an upper end of the outer face 32B on the base end side. The fourth embodiment is identical to the first, second, and third embodiments in terms of a dimension of the extension L.

Therefore, the joint structure of the duct thus constituted can offer basically the same function and effects as the first, second, and third embodiments, and similarly to the second and third embodiments, the geometric moment of inertia of the other member 32 and hence the joint structure portion of the duct increases because the U-shaped groove 32A is bent at an arbitrary position, and the outer face 32B is bent at an arbitrary position, thereby increasing the rigidity of the joint structure portion of the duct.

Fifth Embodiment

Another embodiment (a fifth embodiment) in which a joint structure of a duct according to the present invention is applied to a so-called "Button Punch Snap Seam" will be described.

Figure 9:
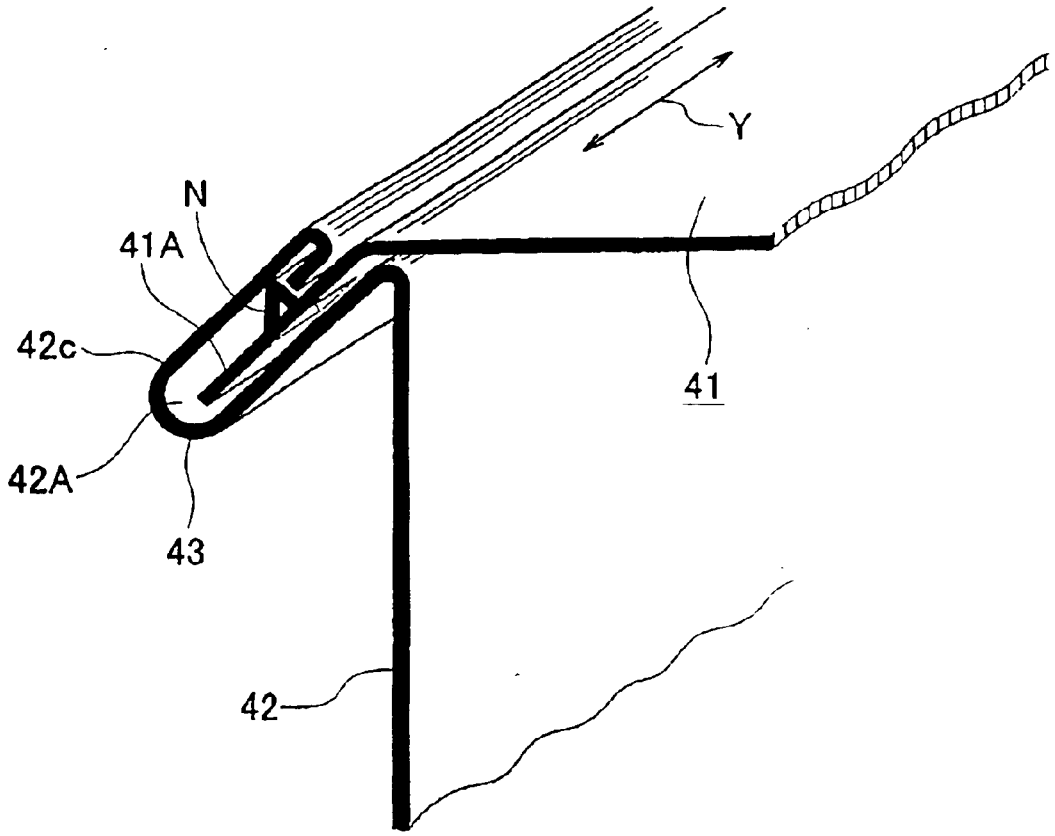
FIG. 9 is a partially enlarged view showing a constitution of a joint structure of a duct according to the fifth embodiment of the present invention, showing a state after the assembly is completed.
Figure 10:
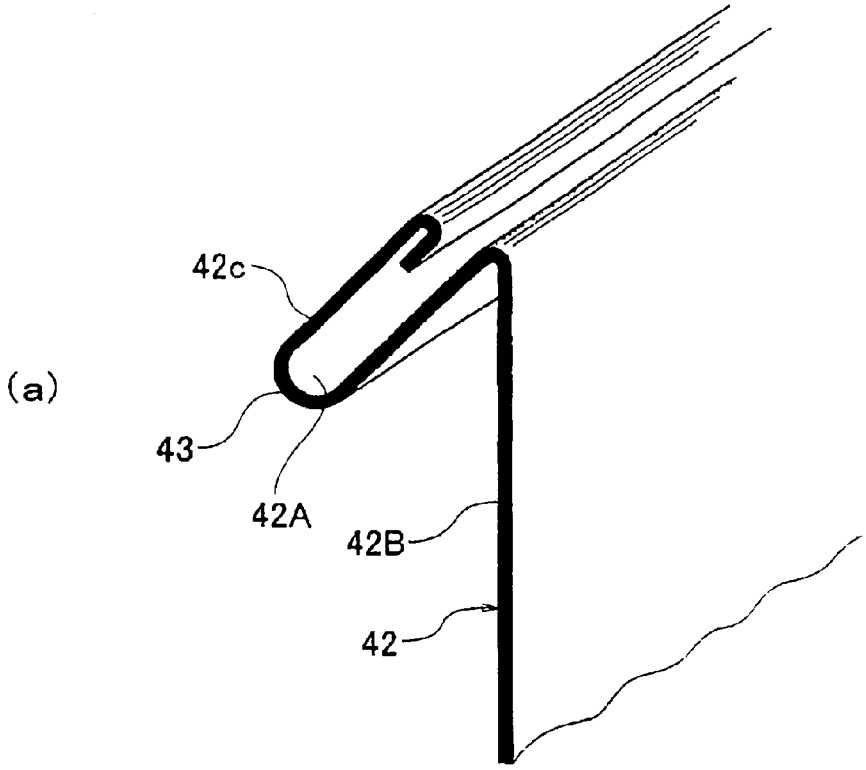
FIG. 10 is a view showing one plate member and the other plate member constituting the joint structure shown in of FIG. 9, wherein FIG. 10(*a*) is a perspective view showing the other member (plate member) of the joint structure shown in FIG. 1, and FIG. 10(*b*) is a perspective view showing the one member (plate member) of the joint structure shown in FIG. 1.
Figure 10:
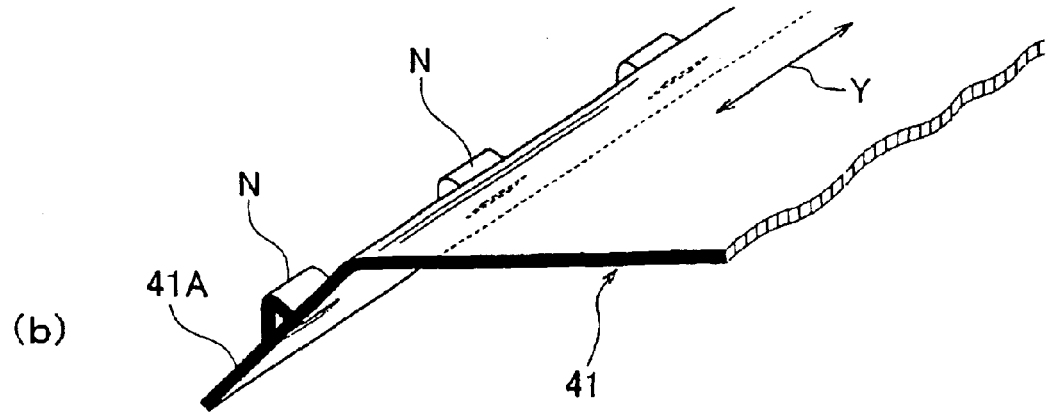

FIG. 9 is partially enlarged views showing a structure of a joint portion of a duct. FIG. 10(*a*) and FIG. 10(*b*) are views showing one member and the other member constituting the joint structure shown in FIG. 9.

In these figures, reference numeral 41 denotes the one plate member, and reference numeral 42 denotes the other plate member. A tip end portion 41A of the one plate member 41, that is, a left end portion in FIG. 10(*b*) is bent to form an angle of approximately 90 degrees or more, for example, an angle of approximately 135 degrees in this embodiment. In the fifth embodiment, as illustrated in FIG. 10(*b*), claws N for engagement are formed intermittently and at fixed intervals in the longitudinal direction (see the direction of an arrow Y in FIG. 10) of the duct.

Furthermore, a U-shaped groove 42A is bent to be adapted to a bending angle of the one member 41, that is, approximately 90 degrees with respect to the outer face 42B located on a base end side of the U-shaped groove 42A and constituting one of the wall faces of the duct in this embodiment. The U-shaped groove 42A is bent obliquely (in the leftward and downward direction in FIGS. 9(*a*), 10(*a*)) and linearly with respect to the outer face 42D located on the base end side of the other member 42.

Thus, a guide rail 43 is formed by the U-shaped groove 42A along the longitudinal direction (a jointing line where the two plate members are in contact with each other; see the direction of the arrow Y in FIG. 9) of the duct.

A free end portion 42C of the U-shaped groove 42A is further bent in a U shape such that a free end 42*c* thereof faces toward a bottom of the U-shaped groove 42A, thereby enabling the claws N for engagement formed on the end portion 41A of the other member 41 to be engaged in.

Figure 11:
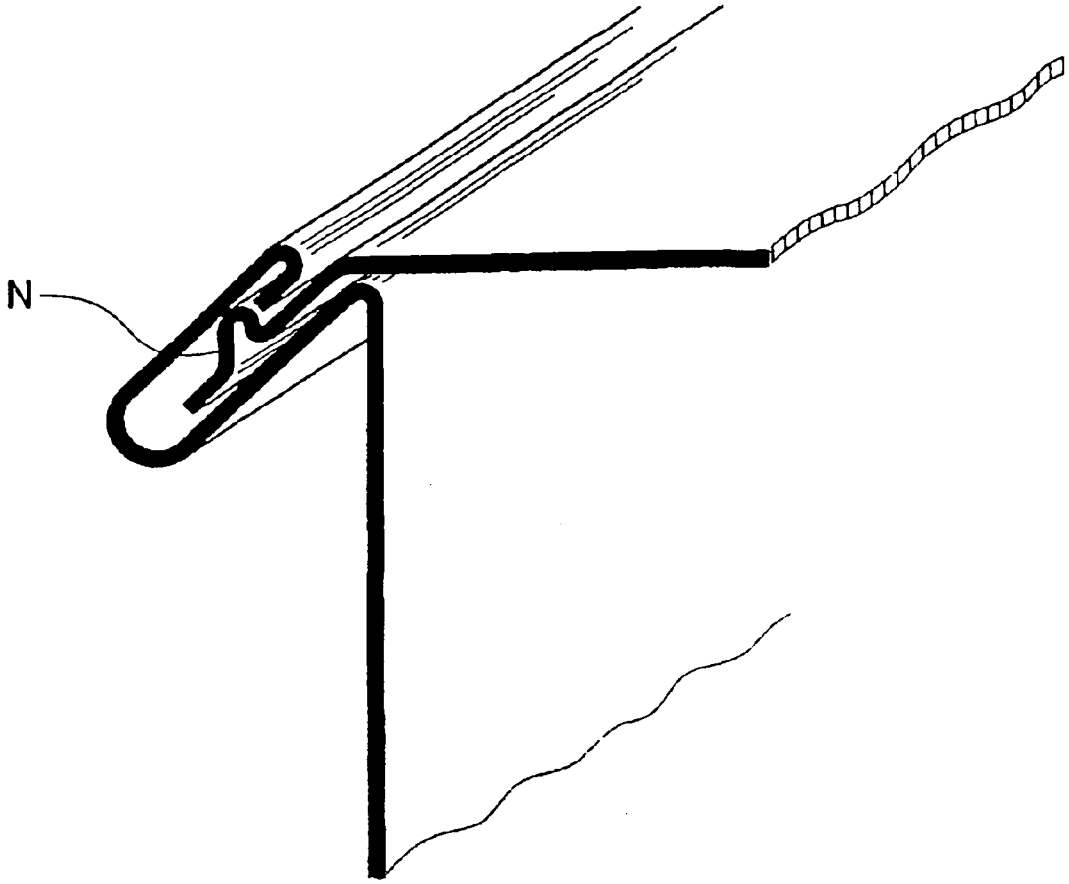
FIG. 11 is a partially enlarged view showing another constitution of the joint structure of the duct according to the fifth embodiment of the present invention, showing a state after the assembly is completed.
Figure 12:
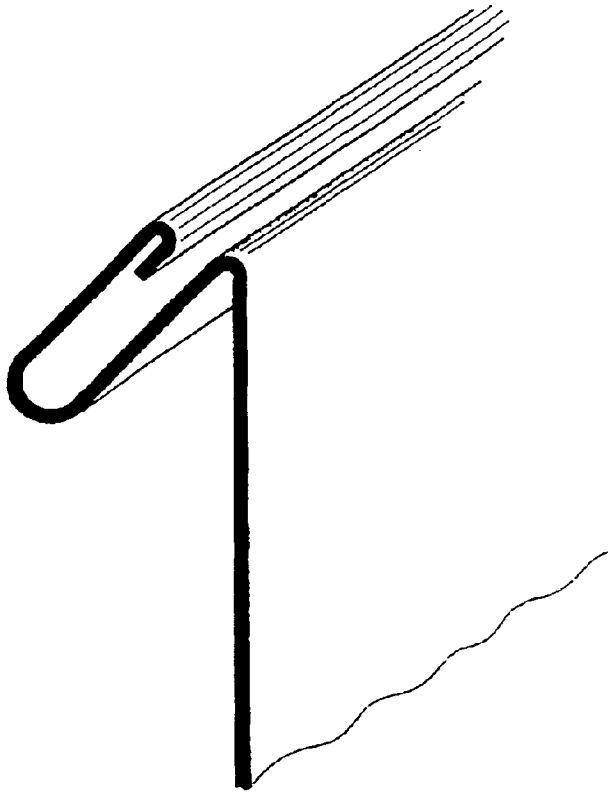
FIG. 12 is a view showing one plate member and the other plate member constituting the joint structure shown in of FIG. 11, wherein FIG. 12(*a*) is a perspective view showing the other member (plate member) of the joint structure shown in FIG. 1, and FIG. 12(*b*) is a perspective view showing the one member (plate member) of the joint structure shown in FIG. 1.
Figure 12:
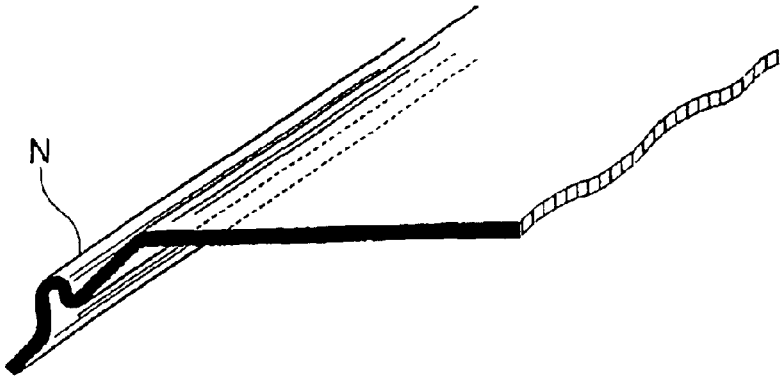

Although, a plurality of the claws N are formed intermittently in this embodiment, the claw N can be formed continuously as shown in FIGS. 11, 12. In this constitution, the geometric moment of inertia of the other member 42 and hence the joint structure portion of the duct can be further increased.

Figure 18:
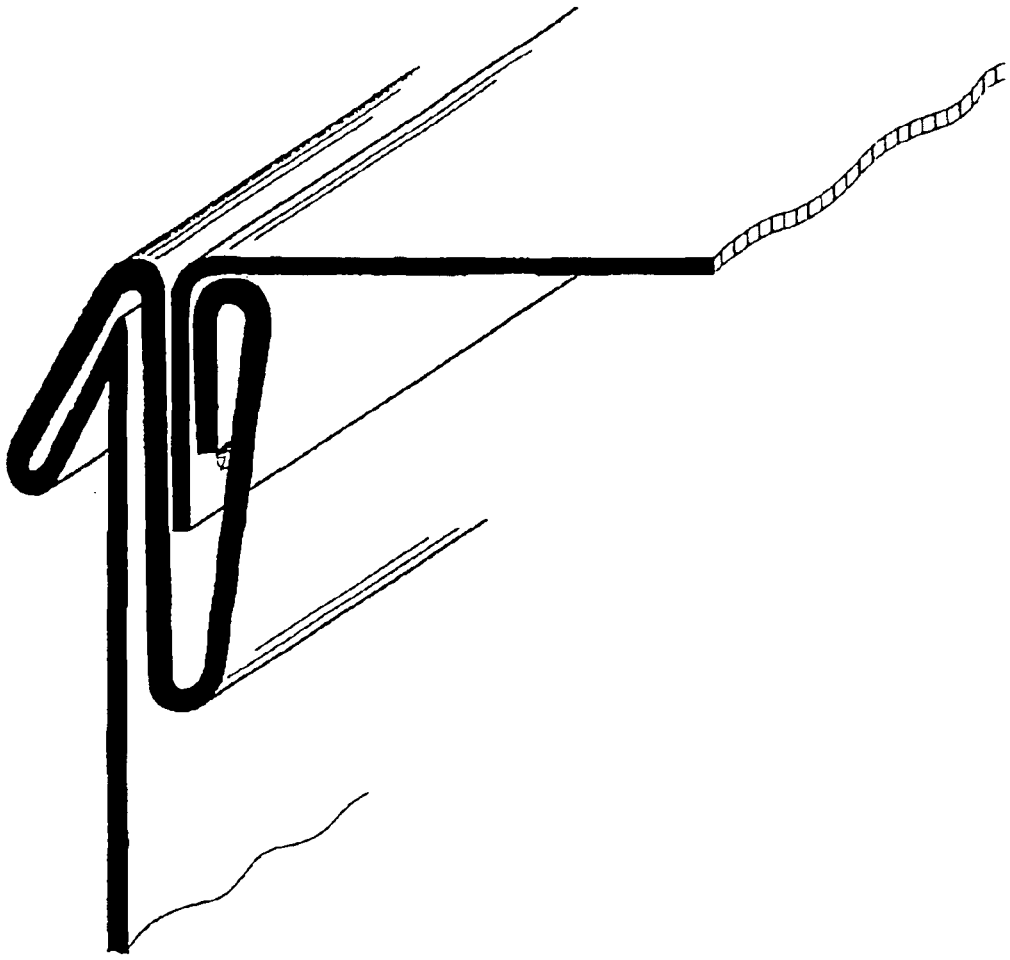
FIG. 18 is a partially enlarged perspective view showing a joint structure of another mode of duct according to the prior invention of the present inventor.

Therefore, the joint structure of the duct thus constituted can be formed easily and stably since the number of bent portions is smaller as compared with the joint structure of the duct shown in FIG. 18 and there is no such a bent portion that a bent portion is further bent. Thus, it is possible for the joint structure to be formed automatically using a forming machine. Furthermore, since the number of bent portions is smaller, and there is no such a bent portion that a bent portion is further bent, the number of forming rollers (in other words, the number of forming steps) can be reduced, and a forming machine with simple structure can be used for the forming.

Furthermore, in view of strength, the rigidity of the joint structure of the present invention is reduced since the number of bent portions is smaller as compared to the joint structure of the duct shown in FIG. 18. This problem can be easily avoided by increasing the thickness of the plate members.

In assembling the joint having one member 41 and the other member 42, the bent left end portion of the one member 41 shown in FIG. 10(*a*) is inserted (pressed in) into the inside through the opening of the U-shaped groove 42A of the other member 42 shown in FIG. 10(*b*), and then, the claw N of the other member 41 is engaged in the free end 42*c* of the U-shaped groove 42A of the other member 42, thereby preventing the one member 41 from coming off the other member 42.

Sixth Embodiment

Another embodiment (a sixth embodiment) in which a joint structure of a duct according to the present invention is applied to a so-called "Button Punch Snap Seam" will be described.

Figure 13:
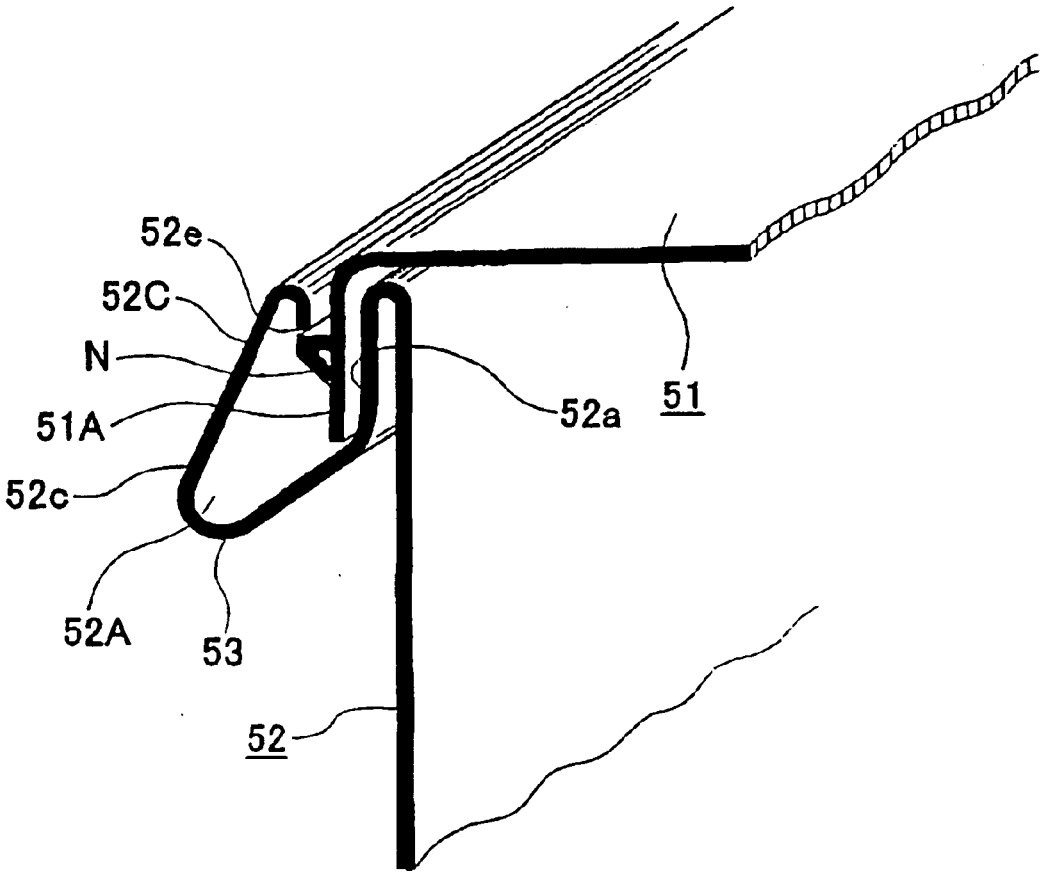
FIG. 13 is a partially enlarged view showing a constitution of a joint structure of a duct according to the sixth embodiment of the present invention, showing a state after the assembly is completed.
Figure 14:
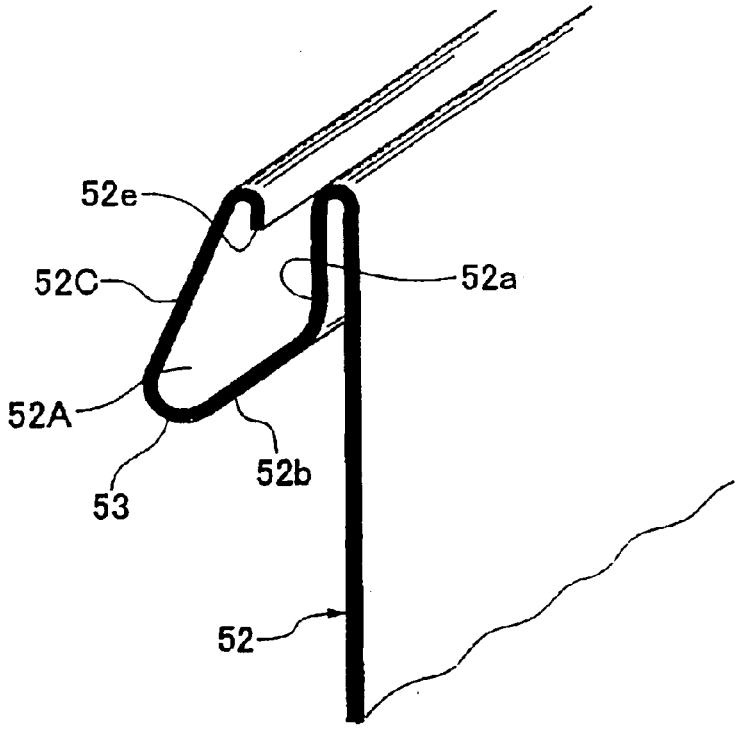
FIG. 14 is a view showing one plate member and the other plate member constituting the joint structure shown in of FIG. 13, wherein FIG. 14(*a*) is a perspective view showing the other member (plate member) of the joint structure shown in FIG. 1, and FIG. 14(*b*) is a perspective view showing the one member (plate member) of the joint structure shown in FIG. 1.
Figure 14:
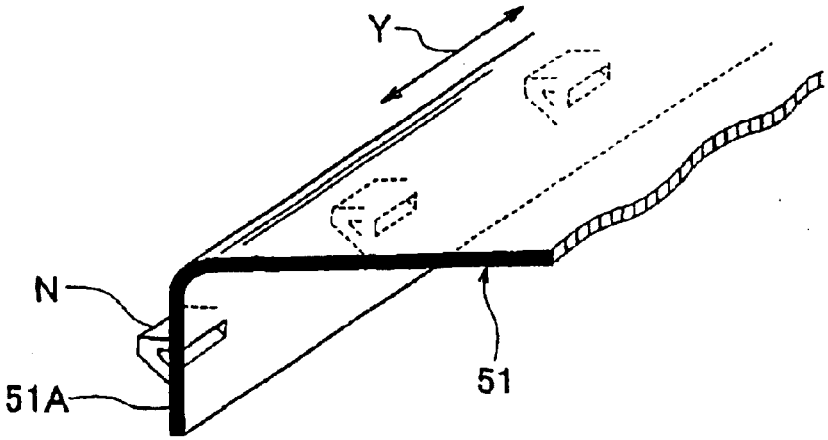

FIG. 13 is partially enlarged views showing a structure of a joint portion of a duct. FIGS. 14(*a*) and 14(*b*) are views showing one member and the other member constituting the joint structure shown in FIG. 13.

In these figures, reference numeral 51 denotes the one plate member, and reference numeral 52 denotes the other plate member. A tip end portion 51A of the one plate member 51, that is, a left end portion in FIG. 14(*b*) is bent to form an angle of approximately 90 degrees or more, for example, an angle of approximately 90 degrees in this embodiment. In the sixth embodiment, as illustrated in FIG. 14(*b*), claws N for engagement are formed in an end portion 51A of the one plate member 51 intermittently and at fixed intervals in the longitudinal direction (see the direction of an arrow Y in FIG. 14(*b*)) of the duct.

Furthermore, a U-shaped groove 52A, or a U-shaped groove 52A partially having a larger inner space in this embodiment to be more accurate, is formed to be adapted to a bending angle of the one member 51, that is, by bending an upper end portion 52*a* of a wall portion on an outer face 52B side of the U-shaped groove 52A to be adapted to a bending angle of the one member 51 and approximately in parallel with the outer face 52B. A lower end portion 52*b* located downward of the upper end portion 52*a* of the U-shaped groove 52A is bent by an angle of approximately 45 degrees with respect to the outer face 52B, and a guide rail 53 is formed by the lower end portion (a portion on the bottom side) 52*b*.

A free end portion 52C of the U-shaped groove 52A is further bent in a U shape such that a free end 52*e* thereof faces toward a bottom of the U-shaped groove 52A, thereby enabling the claws N for engagement formed on a tip end portion 51 A of the one member 51 to be engaged in.

Although a plurality of the claws N are formed intermittently in this embodiment, the claw N can be formed continuously, though not shown. In this constitution, the geometric moment of inertia of the one member 51 and hence the joint structure portion of the duct can be further increased.

Therefore, the joint structure of the duct thus constituted can offer the same function and effects as the fifth embodiment, and since the U-shaped groove 52A is configured such that the width of the larger inner space is greater than that of the opening in cross section, the forming is easy and the geometric moment of inertia can be increased.

Seventh Embodiment

A seventh embodiment in which a joint structure of a duct according to the present invention is applied to a so-called "Button Punch Snap Seam" will be described.

Figure 15:
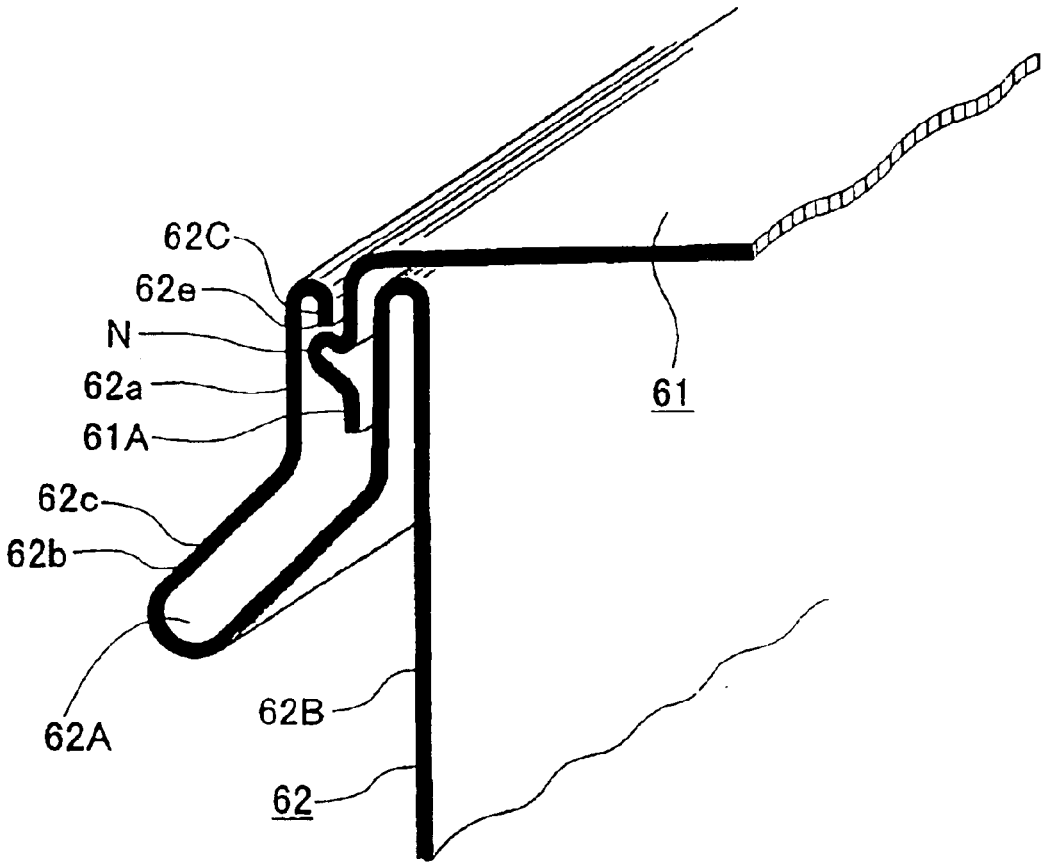
FIG. 15 is a partially enlarged view showing a constitution of a joint structure of a duct according to the seventh embodiment of the present invention, showing a state after the assembly is completed.
Figure 16:
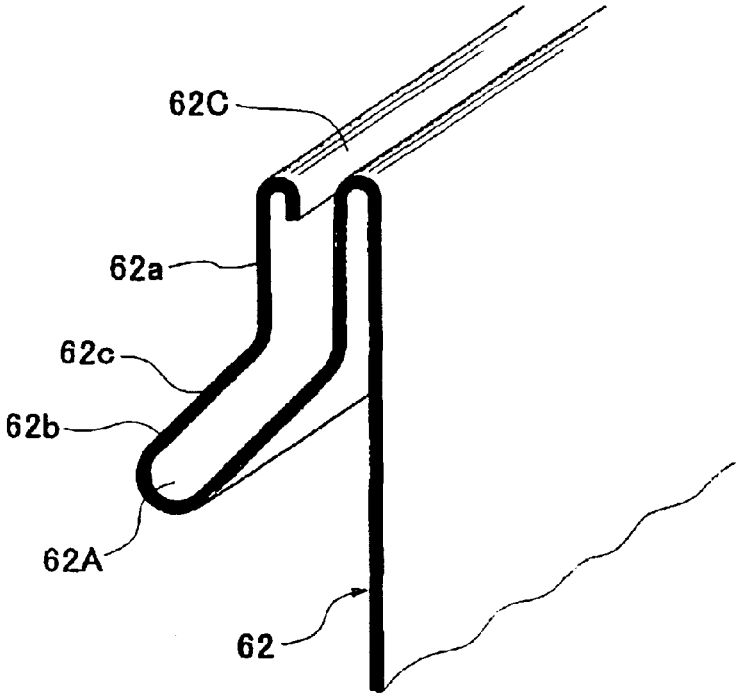
FIG. 16 is a view showing one plate member and the other plate member constituting the joint structure shown in of FIG. 15, wherein FIG. 16(*a*) is a perspective view showing the other member (plate member) of the joint structure shown in FIG. 1, and FIG. 16(*b*) is a perspective view showing the one member (plate member) of the joint structure shown in FIG. 1.
Figure 16:
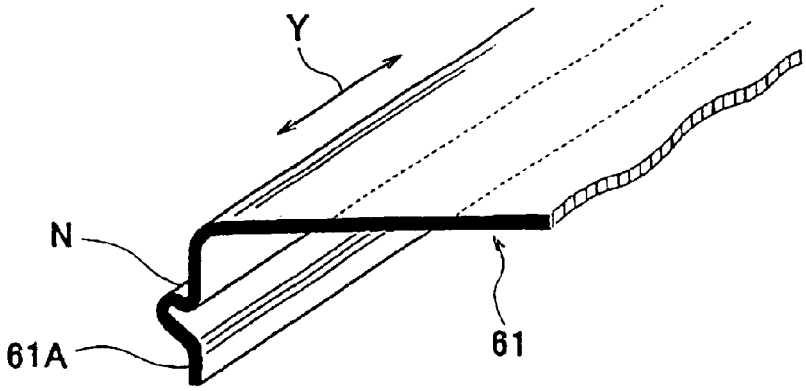

FIG. 15 is a partially enlarged view showing a structure of a joint potion of a duct. FIGS. 16(*a*) and 16(*b*) are views showing one member and the other member constituting the joint structure shown in FIG. 15.

In these figures, reference numeral 61 denotes the one plate member, and reference numeral 62 denotes the other plate member. A tip end portion 61 A of the one plate member 61, that is, a left end portion in FIG. 16(*b*) is bent to form an angle of approximately 90 degrees or more, for example, an angle of approximately 90 degrees in this embodiment. In the seventh embodiment, as illustrated in FIG. 16(*b*), a claw N for engagement is formed continuously at the tip end portion 61 A of the one plate member 61 and in the longitudinal direction (see the direction of an arrow Y in FIG. 16(*b*)) of the duct.

Furthermore, a U-shaped groove 62A is formed at a tip end portion 62*c* of the other plate member 62. In the seventh embodiment, an upper end portion (in the vicinity of an opening) 62*a* of the U-shaped groove 62A is bent to be adapted to a bending angle of the one member 61, that is, an angle of approximately 90 degrees in the seventh embodiment, and a lower end portion (a portion on the bottom side) 62*b* is bent by an angle of approximately 45 degrees with respect to the outer face 62B. That is, in the seventh embodiment, the U-shaped groove 62A is bent obliquely and outwardly (laterally; in the leftward and downward direction in FIGS. 15(*a*), 16(*a*)) at an arbitrary position.

Thus, a guide rail 63 is formed by a portion on a bottom side of the U-shaped groove 62A along the longitudinal direction of the other member 62, or of the duct in other words.

A free end portion 62C of the U-shaped groove 52A is further bent inward of the U-shaped groove 62A in a U shape such that a free end 62*e* thereof faces toward a bottom of the U-shaped groove 62A and thereby enables the claw N for engagement formed on a tip end portion 61 A of the one member 61 to be engaged in.

Although the claw N is formed continuously in the longitudinal direction of the duct in this embodiment, a plurality of the claws N may be formed intermittently. However, if the claw is formed continuously as in the seventh embodiment, the geometric moment of inertia of the one member 61 and the joint structure portion of the duct can be further increased.

Therefore, the joint structure of the duct thus constituted can offer basically the same function and effects as the fifth and sixth embodiments, and since the claw N is formed continuously, the geometric moment of inertia of the one member 61 can be increased.

Figure 20:
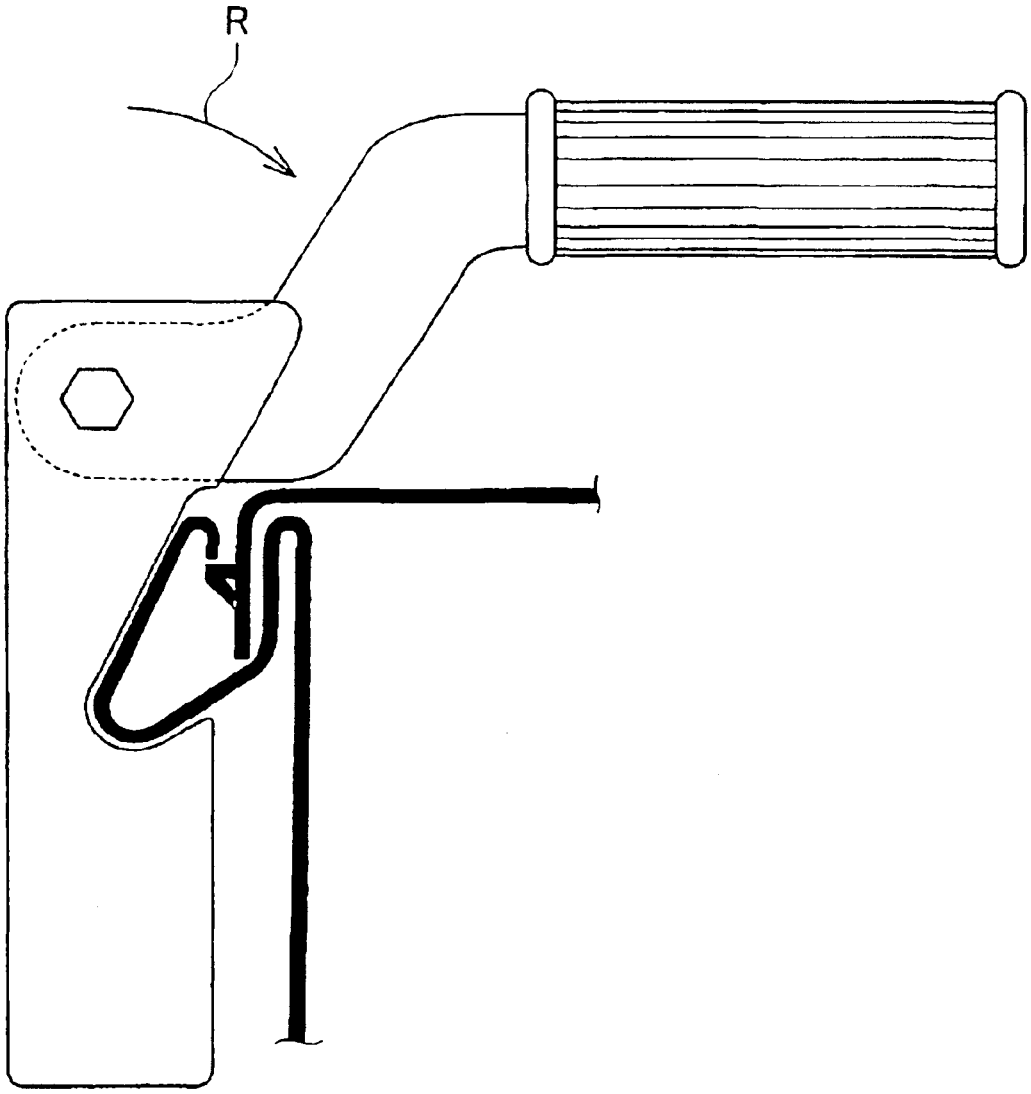
FIG. 20 is a view showing a hand tool for use in assembling a joint of a duct and a joint structure to be assembled therewith.
Figure 21:
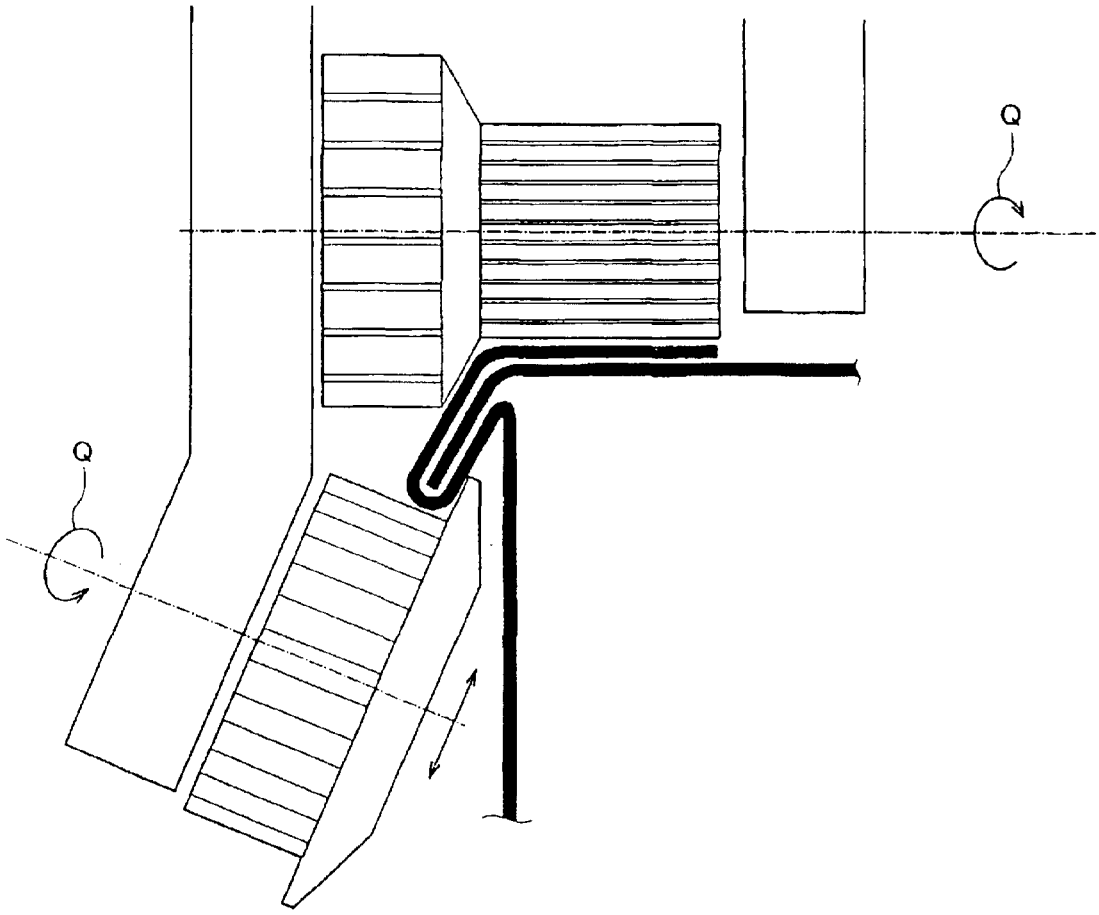
FIG. 21 is a view showing an electric tool for use in assembling a joint of a duct and a joint structure to be assembled therewith.
Figure 22:
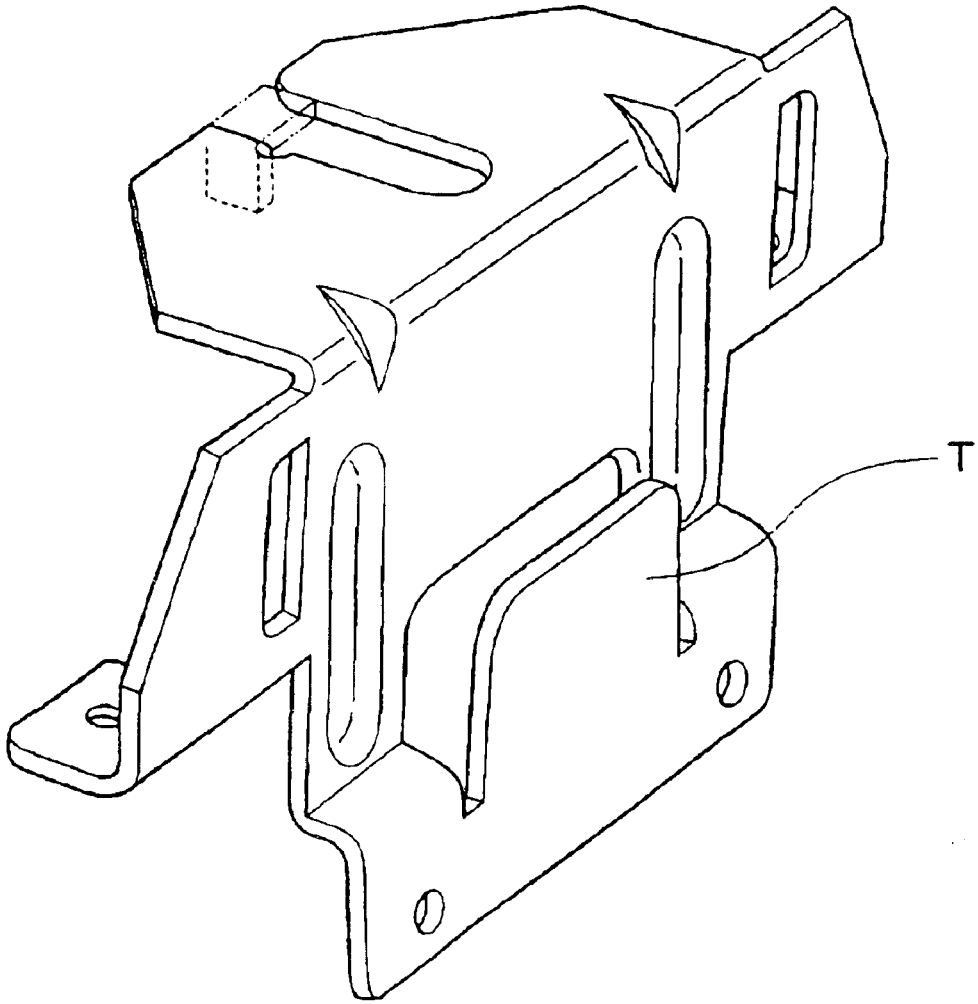

By the way, similarly to the case of the joint structure of the duct shown in FIGS. 17 and 18, the joint structure of the duct thus constituted can be assembled even by a weak person like a woman alone using a special hand assembling tool as shown in FIG. 20 or an electric assembling tool as shown in FIG. 21 without producing a large noise and with very high efficiency. An arrow R in FIG. 20 indicates movement of the assembling tool during assembly, and an arrow Q in FIG. 21 indicates a rotational direction of a roller when the assembling tool moves toward the cut-away surface of FIG. 21. What is more, since one plate member and the other plate member can be assembled on site as needed, the storage efficiency at a warehouse and on site becomes very high, and the delivery efficiency also becomes high. In addition, in hanging the duct, a tongue piece T of a hanger as shown in FIG. 22 is engaged in the guide rail, and both wing portions W1, W2 are bent toward the tongue piece T, thereby fixing the duct with the tongue piece T and both of the wing portions W1, W2. Thus, the duct can be hung at any point of left and right portions thereof using the hangers, thereby enabling the duct to be hung easily even if there is a beam in a house.

Figure 19:
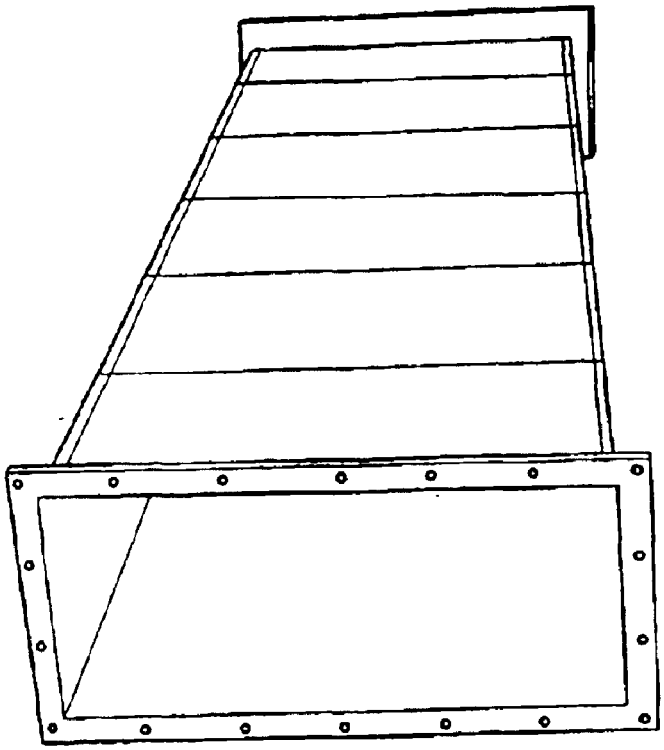
FIG. 19 is a perspective view showing an appearance of a whole duct.

By the way, while, in the above embodiments, the joint structure of one jointing portion where the one member and the other member are jointed together was described, it should be obvious to those skilled in the art without saying that the joint structure is also formed at other jointing portions, that is, two of the one members and two of the other members are assembled together by forming the jointing portions at four corners, thereby achieving the duct shown in FIG. 19.

Therefore, the joint structure of the duct thus constituted can be formed easily and stably, and it can be formed using a forming machine with simple structure.

Of course, the duct comprising this joint structure is similar to those comprising the joint structure shown in FIGS. 17, 18 and can be assembled with a minimum of noise and quickly even by a woman through a simple operation, thereby enabling the duct to be assembled in accordance with the status of work progress.

Thus, because the duct comprising this joint structure can be stored in the form of plate members, they can be stored if the ducts are produced as standard goods on a large scale, they can be delivered with a truck loaded up to the allowable load capacity when delivered to a construction site, thereby increasing delivery efficiency.

What is claimed is:

1. A joint structure of a duct in which a guide rail extends along a jointing line at which two plate members of the duct are substantially orthogonal to each other in cross section in the vicinity of the jointing line, the joint structure of the duct comprising:

an end portion of one of the two plate members is bent to form an angle of 90 degrees or more;

a U-shaped groove is formed in a tip end portion of the other plate member such that at least an opening portion of the groove is adapted to a bending angle of the one plate member so as to accommodate a bent tip end portion of the one plate member in an end portion of the other plate member; and the guide rail is formed by the U-shaped groove that accommodates the bent tip end portion of the one plate member by protruding at least a portion on a bottom side of the U-shaped groove of the other plate member obliquely from an outer face located on a base end side of a portion where the U-shaped groove is formed and constituting one of the wall faces of the duct.

2. The joint structure of a duct according to claim 1, wherein the portion on the bottom side of the U-shaped groove protrudes from the outer face located on the base end side of a portion where the U-shaped groove is formed and constituting one of the wall faces of the duct.

3. A joint structure of a duct in which a guide rail extends along a jointing line at which two plate members of the duct are substantially orthogonal to each other in cross section in the vicinity of the jointing line, the joint structure of the duct comprising:

an end portion of one of the two plate members is bent to form angle of 90 degrees or more;

a U-shaped groove is formed in a tip end portion of the other plate member such that at least an opening portion of the groove is adapted to a bending angle of the one plate member so as to accommodate a bent tip end portion of the one plate member in an end portion of the other plate member;

the guide rail is formed by protruding at least a portion on a bottom side of the U-shaped groove of the other plate member obliquely and linearly from an outer face located on a base end side of a portion where the U-shaped groove is formed and constituting one of the wall faces of the duct.

* * * * *

UNITED STATES PATENT AND TRADEMARK OFFICE

CERTIFICATE OF CORRECTION

PATENT NO. : 6,814,106 B1
DATED : November 9, 2004
INVENTOR(S) : Shozo Iizuka

It is certified that error appears in the above-identified patent and that said Letters Patent is hereby corrected as shown below:

Title page,
Item [73], Assignee, delete "sir" and insert -- Air --.

Signed and Sealed this

Thirty-first Day of January, 2006

JON W. DUDAS
*Director of the United States Patent and Trademark Office*